US005583100A

United States Patent [19]

Okamoto et al.

[11] Patent Number: 5,583,100

[45] Date of Patent: Dec. 10, 1996

[54] OIL COMPOSITIONS FOR HOT ROLLING ALUMINUM AND ALUMINUM ALLOYS

[75] Inventors: Yoshio Okamoto; Yukio Sugishita; Hiroyuki Andoh; Kuniaki Matsui, all of Mooka; Takehiko Ichimoto; Masataka Negishi, both of Wakayama, all of Japan

[73] Assignees: Kabushiki Kaisha Kobe Seiko Sho, Kobe; Kao Corporation, Tokyo, both of Japan

[21] Appl. No.: 314,070

[22] Filed: Sep. 28, 1994

[30] Foreign Application Priority Data

Oct. 8, 1993 [JP] Japan ..... 5-252659

[51] Int. Cl.[6] ..... C10M 145/14

[52] U.S. Cl. ..... 508/441; 508/545; 508/554

[58] Field of Search ..... 252/49.8, 51.5 A, 252/49.5; C10M 149/04, 149/06

[56] References Cited

U.S. PATENT DOCUMENTS 4,663,061 5/1987 Kuwamoto et al. ..... 252/32.5
4,693,839 9/1987 Kuwamoto et al. ..... 252/51.5 A

FOREIGN PATENT DOCUMENTS 2-145692 6/1990 Japan .

*Primary Examiner*—Prince Willis, Jr.
*Assistant Examiner*—Cephia D. Toomer
*Attorney, Agent, or Firm*—Oblon, Spivak, McClelland, Maier & Neustadt, P.C.

[57] ABSTRACT

A water-dispersible oil composition for hot rolling aluminum or aluminum alloys having excellent lubricity and emulsion stability and which minimizes heat deterioration over prolonged periods of time contains the following components (a) to (d): (a) a mineral oil, (b) 3 to 30% by weight of a fatty acid or its monoesters, or oils and fats, (c) 0.5 to 10% by weight of a $C_4$–$C_{18}$ alkyl or alkenyl phosphoric (or phosphorous) acid ester, and (d) 0.1 to 10% by weight of a salt between a polymer and an organic acid salt, wherein the polymer has an average molecular weight of 10,000 to 1,000,000 and is a copolymer of a monomer represented by formula (1):

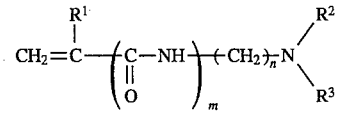

(1)

wherein $R^1$ is H or Me, $R^2$ and $R^3$ are independently H or $C_1$–$C_3$ alkyl, m is an integer of 0 or 1, and n is an integer of 1, 2 or 3, and (meth) acrylamide and/or a (meth) acrylic acid salt. Rolled aluminum or aluminum alloy products having excellent surface quality can be obtained using this composition.

7 Claims, No Drawings

OIL COMPOSITIONS FOR HOT ROLLING ALUMINUM AND ALUMINUM ALLOYS

BACKGROUND OF THE INVENTION

1. Field of the Invention

The present invention concerns a water-dispersible oil composition for hot rolling aluminum and aluminum alloys, which has excellent rolling lubricity and emulsion stability, and which provides a rolled sheet with an excellent surface quality.

2. Discussion of the Background

In the process of hot rolling aluminum and aluminum alloys, a so-called roll coating is formed on the surface of the rolls as a result of the transfer of aluminum from the surface of the rolled plate to the surface of the rolls. If the rolls have a roll coating thereon, a billet is rolled while in contact with the roll coating. This means that the surface quality of the rolled plate varies according to the properties of the roll coating, and defects in the surface affect the quality of the plate surface after cold rolling. Thus, the nature of the roll coating is very important. It varies depending on the rolling conditions (materials to be rolled, temperature of the plates, roughness of the plate surface, temperature of the rolls, roughness of the roll surface, draft, rolling speed, brush roll operating conditions, etc.) and the kinds of rolling oils. Accordingly, selection of a rolling oil is essential in the control of roll coatings.

In hot rolling, rolling oils are used in the form of an emulsion since sufficient roll cooling properties are required. Conventional hot rolling oils for aluminum and aluminum alloys are emulsions having concentrations of 3 to 10% of oil components. They are generally prepared by incorporating oil performance improvers; extreme pressure agents; anti-rusting agent; anti-oxidants; etc. into mineral oil as base oil and emulsifying the resulting mixture, primarily with anionic surfactants. Oil performance improvers may include fatty acids, oils and fats, and fatty esters.

Desirable features for oils for hot rolling aluminum and aluminum alloys include lubricity, good roll coating properties, good surface quality, emulsion stability, workability, and waste treatment properties. Especially in recent years, the need to carry out mass production and the desire for high quality in rolled aluminum products have resulted in the demand for hot rolling oils having high levels of lubricity, surface quality and emulsion stability. However, conventional oils for hot rolling aluminum and aluminum alloys do not sufficiently meet all these requirements.

In conventional rolling oils, lubricity has been controlled by changing the kinds and amounts of emulsifiers. However, in conventional hot rolling oils which contain emulsifiers, lubricity and emulsion stability tend to clash, and both properties typically cannot be met at the same time. Namely, when the lubricity increases, the emulsion stability decreases, causing deteriorated lubrication stability over time. Likewise, when the emulsion stability is enhanced, sufficient lubricity cannot be obtained. Eventually, the plate surface develops defects. Therefore, constant quality of rolled plate surfaces over time generally are not obtained with conventional rolling oils.

Japanese Patent Publication (kokoku) No. 14599/1987 discloses a rolling oil composition in which the lubricity and emulsion stability are both satisfied. Although the technique of this publication is unique and successful in uniting lubricity and emulsion stability, the surface quality of the obtained rolled plates is not necessarily satisfactory. Japanese Patent Application Laid-open (kokai) No. 120795/1988 discloses a similar approach. The technique of this publication is essentially the same as disclosed in Japanese Patent Publication (kokoku) No. 14599/1987, but this publication improves the surface quality by sacrificing lubricity.

Thus, in conventional oils for hot rolling aluminum and aluminum alloys, satisfactory levels of lubricity, emulsion stability and surface quality typically are not provided simultaneously. Therefore, conventional oils are generally unsuitable for mass production of aluminum or aluminum alloys in present-day methods of rolling, and have difficulty in meeting the desire for rolled products of high quality.

In view of the foregoing, the present inventors found that good lubricity, emulsion stability and surface quality can be simultaneously obtained by emulsifying and dispersing a specified lubricant component in water using a specified polymer compound. A patent application (Japanese Patent Application Laid-open (kokai) No. 145692/1990) has been filed, directed towards these findings. However, further research revealed that this hot rolling oil composition is not free from heat degradation after long term use under severe hot rolling conditions. Such heat degradation deteriorates the performance of the composition and the surface of the rolled aluminum or aluminum alloy.

As a consequence, a need still exists for an oil composition which, when emulsified in water, provides satisfactory levels of lubricity, emulsion stability and surface quality simultaneously over a prolonged period of time.

SUMMARY OF THE INVENTION

Accordingly, one object of the present invention is to provide an oil composition for hot rolling aluminum or an alloy thereof which has excellent lubricity and emulsion stability.

A further object of the present invention is to provide an oil composition for hot rolling aluminum or an alloy thereof which imparts an excellent surface quality to rolled materials.

A further object of the present invention is to provide an oil composition for hot rolling aluminum or an alloy thereof which suppresses heat degradation even after long use.

The present inventors have continued their studies, and as a result, have found that deterioration in performance due to heat degradation after use over time can be markedly reduced while good lubricity, emulsion stability and surface quality are obtained, by replacing the polymer compound in the hot rolling oil described in Japanese Patent Application Laid-open (kokai) No. 145692/1990 with a salt of (i) a copolymer of a specified monomer and (ii) an organic acid.

These and other objects, which will become apparent during the following detailed description of the preferred embodiments, are provided by a water-dispersible oil composition for hot rolling aluminum or an aluminum alloy, comprising the following components (a) to (d) :

(a) a mineral oil having a viscosity at 40° C. of not more than 80 cSt, (b) 3 to 30% by weight of a compound selected from the group consisting of $C_{10}$–$C_{22}$ fatty acids, oils and fats monoesters composed of a $C_{10}$–$C_{22}$ fatty acid and a $C_1$–$C_{22}$ alcohol, and mixtures thereof, (c) 0.5 to 10% by weight of a $C_4$–$C_{18}$ alkyl or alkenyl ester of phosphoric acid or phosphorous acid, (d) 0.1 to 10% by weight of a salt of a polymer and an organic acid, wherein the polymer has a weight average molecular weight of 10,000 to 1,000,000 and is a copolymer of one or more monomers represented by the following formula (1):

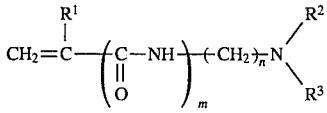

(1)

wherein $R^1$ is hydrogen or methyl, $R^2$ and $R^3$ are independently hydrogen or $C_1$–$C_3$ alkyl, m is an integer of 0 or 1, and n is an integer from 1 to 3, and at least one additional monomer selected from the group consisting of (meth)acrylamide and salts of (meth)acrylic acid, and the organic acid is represented by the following formula (2):

$$R^4COOH \quad (2)$$

wherein $R^4$ is $C_1$–$C_5$ alkyl, hydroxy-$C_1$–$C_5$-alkyl, carboxy-$C_1$–$C_5$-alkyl or carboxyl.

These and other objects, features and advantages of the present invention will become apparent from the following detailed description of the preferred embodiments of the present invention.

DETAILED DESCRIPTION OF PREFERRED EMBODIMENTS

The present oil composition is typically emulsified with water prior to its use in hot rolling. Thus, it is preferred that the present oil composition be dispersible in water. However, the present oil composition has utility as a lubricant and/or as a dispersant, independent of its use as an oil-in-water emulsion for hot rolling aluminum or an aluminum alloy.

Examples of the present component (a) include mineral oil in its varied forms (e.g., spindle oils, machine oils, turbine oils, cylinder oils, neutral oils, etc.). Of these, mineral oils of a paraffin series are preferred in view of their heat resistance and lubricity. The viscosity of the mineral oils is preferably not more than 80 cSt at 40° C. A viscosity exceeding 80 cSt may deteriorate the surface quality of the plate. Component (a) serves as a base oil, and therefore, the amount in the oil composition is not particularly limited. However, it is preferred that this component be incorporated in an amount from 38 to 96.4% by weight, preferably from 50 to 96.4% by weight, more preverably from 60 to 85% by weight.

Examples of component (b) include animal and vegetable fats and oils, such as whale oil, beef tallow, lard, rapeseed oil, castor oil, palm oil, and coconut oil. Examples of $C_{10}$–$C_{22}$ fatty acids include capric acid, lauric acid, stearic acid, isostearic acid, oleic acid, and erucic acid. The fatty acid monoesters include those monoesters of a $C_{10}$–$C_{22}$ fatty acid and an alcohol selected from $C_1$–$C_{22}$ aliphatic monohydric alcohols, ethylene glycol, trimethylolpropane, pentaerythritol, glycerin, etc. Specific examples of the fatty acid monoesters include methyl caprate, butyl stearate, lauryl oleate, 2-ethylhexyl erucate, pentaerythritol monooleate, glycerin monooleate, etc.

Component (b) acts as an oil performance improver. Component (b) may be a single compound, or may contain a mixture of suitable compounds. It is preferred that the amount of component (b) be from 3 to 30% by weight, and more preferably, from 10 to 25% by weight of the oil composition. Amounts less than 3% by weight may lower the lubricity, whereas amounts higher than 30% by weight may deteriorate the surface quality of the rolled products. When oils and/or fats are present as the sole source of component(s) (b), the oils and/or fats are present in an amount preferably up to 20% by weight based on the total weight of the oil composition.

Component (c) is one or more $C_4$–$C_{18}$ alkyl or alkenyl esters of phosphoric or phosphorous acid. Examples of compound (c) include dibutyl phosphate, monooctyl phosphate, trioleyl phosphate, tributyl phosphate, diisooctyl phosphate and trioleyl phosphate. Among the mono-, di- and triesters, mono- and dialkyl and -alkenyl phosphates and mono- and dialkyl and alkenyl phosphites are particularly preferred.

It is also preferred that the amount of compound (c) be from 0.5 to 10% by weight, and more preferably, from 1 to 5% by weight of the oil composition. Amounts less than 0.5% by weight may not be effective in improving the surface quality of the rolled plate, whereas amounts higher than 10% by weight may provide no significant additional improvement.

Examples of the polymer of component (d) include copolymers of a monomer represented by formula (1) and (meth)acrylamide, copolymers of a monomer represented by formula (1) and a (meth)acrylic acid salt, and copolymers of a monomer represented by formula (1), (meth)acrylamide and a (meth)acrylic acid salt. It is preferred that the monomer represented by formula (1) be present in the polymer in a molar percentage of from 50 to 90%, (meth)acrylamide be present in the polymer in a molar percentage of from 0 to 20%, and the (meth)acrylic acid salt be present in the polymer in a molar percentage of from 10 to 50%.

In the organic acid of component (d), $R^4$ is $C_1$–$C_5$ alkyl, hydroxy-$C_1$–$C_5$-alkyl, carboxy-$C_1$–$C_5$-alkyl or carboxyl. Of these, hydroxy-$C_1$–$C_5$-alkyl groups are particularly preferred. Specific examples of $R^4COO^-$ include acetate, propionate, butyrate, valerate, caprate, glycolate, lactate, hydroacrylate, oxalate, malonate, succinate, glutamate, adipate, etc. Especially, glycolate, lactate, and acrylate are preferred.

Examples of amines in the monomers of the formula (1) include dimethylaminoethyl acrylamide, dimethylaminopropyl acrylamide, diethylaminomethyl acrylamide, dimethylaminoethyl methacrylamide, dimethylaminopropyl methacrylamide and diethylaminomethyl methacrylamide, all of which are compounds of formula (1) wherein m=1; and allylamine, dimethylaminomethyl ethylene, diethylaminomethyl ethylene, dimethylaminomethyl propene, diethylaminomethyl propene, which are compounds of formula (1) wherein m=0. Of these, compounds of formula (1) in which m=1 are particularly preferred. Examples of particularly preferable monomer (1) include dimethylaminopropyl methacrylamide and diethylaminopropyl acrylamide, and the most preferred neutralization product of the copolymer is that with glycolic acid.

Examples of the (meth)acrylic acid salt include alkali metal salts such as a sodium (meth)acrylate and potassium (meth)acrylate, and organic amine salts such as monoethanolammonium (meth)acrylate, diethanolammonium (meth-)acrylate, and triethanolammonium (meth)acrylate.

It is preferred that the weight average molecular weight of the component (d) polymer be from 10,000 to 1,000,000. Weight average molecular weights lower than this range may cause a deteriorated emulsion stability, whereas those exceeding this range may render the composition highly viscous, resulting in difficult handling. More preferable weight average molecular weights are from 30,000 to 300,000.

In preparing the polymer, a monomer of the formula (1) neutralized with an organic acid of the formula (2) may be used. For example, copolymer (d) can be obtained by polymerizing dimethylaminopropyl methacrylamide neutralized with glycolic acid and comonomer.

The component (d) polymer may be used singly or in combination of two or more. The amount of the component (d) is from 0.1 to 10% by weight, and preferably, from 0.5 to 5% by weight based on the total weight of the oil composition. Amounts exceeding 10% by weight are not favorable because performance of the pressure resistant load may become poor and the anti-seizure property of the composition may be deteriorated.

The present oil compositions for hot rolling aluminum and aluminum alloys may optionally contain, if desired, known additives such as anti-rusting/anti-corrosion agents, antioxidants and emulsifiers for improving the initial emulsifying ability.

Examples of anti-rusting/anti-corrosion agents include alkenylsuccinic acid and its derivatives (e.g. salts and $C_1$–$C_5$-alkyl esters), fatty acids such as oleic acid, esters such as sorbitan monooleate, and amines. They may be incorporated into the present oil composition in an amount up to 2% by weight based on the total weight of the composition.

Examples of antioxidants include phenol compounds such as 2,4-di-tert-butyl-p-cresol, and aromatic amines such as phenyl-alpha-naphthylamine. They may be incorporated into the present oil composition in an amount up to 5% by weight based on the total weight of the composition.

Examples of emulsifiers include anionic surfactants such as triethanolammonium oleate and sodium petroleum sulfonates, and nonionic surfactants such as poly(oxyethylene) nonylphenyl ether. They may be incorporated into the present oil composition in an amount of up to 2% by weight based on the total weight of the oil composition.

The present oil compositions for hot rolling aluminum and aluminum alloys may be diluted with water and emulsified before use. The dilution ratio is not particularly limited, but it is preferred that the dilution be performed so that the concentration of the oil composition is from 1 to 30% by weight of the emulsion.

The polymer of component (d) preferably provides advantageous electric cohesion, stereo-hindrance and protective colloid effects, and is resistant to high temperatures. The present oil composition is capable of maintaining a uniform dispersion of emulsified particles and a constant particle distribution of a suitable particle size under severe hot rolling conditions for a long time. Therefore, the initial good rolling lubricity can be maintained for a prolonged period. In addition, component (b) preferably provides an advantageous roll-coating controlling effect, and the polymer of component (d) also preferably provides an advantageous thin and uniform roll coating. Thus, surfaces of aluminum or aluminum alloy plates having minimized defects and uniform quality can be obtained.

Other features of the invention will become apparent in the course of the following descriptions of exemplary embodiments which are given for illustration of the invention and are not intended to be limiting thereof.

EXAMPLES

The present invention will now be described by way of examples, which however, should not construed as limiting.

Example 1

The oil compositions (invention product Nos. 1–5 and comparative product Nos. 1–6) were formulated as described below and prepared identically according to a known method. The polymers are referred to as "polymer dispersants".

| | wt. % |
|---|---|
| Invention product No. 1: | |
| Component (a): | |
| Mineral oil of a paraffin series (70 cSt/40° C.) | 61.5 |
| Component (b): | |
| Oleic acid | 15.0 |
| Lard | 15.0 |
| Component (c): | |
| Dilaurylphosphite | 3.0 |
| Component (d): | |
| Polymer dispersant (A): the neutralization product of acetic acid with a 80/5/15 copolymer of dimethylaminopropyl acrylamide/acrylamide/sodium acrylate (MW = 400,000) | 2.0 |
| Others: | |
| Tricresyl phosphate | 2.0 |
| Antioxidant (2,4-di-tert-butyl-p-cresol) | 1.0 |
| Nonionic surfact (I): Polyoxyethylene nonylphenyl ether (HLB = 12.4) | 0.5 |
| Total | 100.0 |
| Invention product No. 2: | |
| Component (a) | |
| Mineral oil of a paraffin series (60 cSt/40° C.) | 73.0 |
| Component (b): | |
| Isostearic acid | 15.0 |
| Lauric acid | 2.0 |
| Butyl stearate | 5.0 |
| Component (c): | |
| Trioleylphosphate | 1.0 |
| Component (d): | |
| Polymer dispersant (B): the neutralization product of glycolic acid with a 85/15 copolymer of dimethylaminopropyl methacrylamide/sodium methacrylate (MW = 80,000) | 3.0 |
| Others: | |
| Antioxidant (2,4-di-tert-butyl-p-cresol) | 1.0 |
| Total | 100.0 |
| Invention product No. 3: | |
| Component (a) | |
| Mineral oil of a paraffin series (20 cSt/40° C.) | 80.5 |
| Component (b): | |
| Lauric acid | 5.0 |
| Palm oil | 5.0 |
| Oleyl oleate | 5.0 |
| Component (c): | |
| Dioleylphosphate | 2.5 |

| | wt. % |
|---|---|
| Component (d): | |
| Polymer dispersant (C): the neutralization product of lactic acid with a 75/25 copolymer of dimethylaminomethylethylene/ triethanolammonium acrylate (MW = 100,000) | 0.5 |
| Others: | |
| Antioxidant (2,4-di-tert-butyl-p-cresol) | 1.0 |
| Anti-rusting/anti-corrosion agent ($C_{18}$-alkenylsuccinic acid) | 0.5 |
| Total | 100.0 |
| Invention product No. 4: | |
| Component (a): | |
| Mineral oil of a paraffin series (30 cSt/40° C.) | 69.5 |
| Component (b): | |
| Oleic acid | 20.0 |
| Lauryl oleate | 5.0 |
| Component (c): | |
| Dibutylphosphate | 2.5 |
| Component (d): | |
| Polymer dispersant (D): the neutralization product of succinic acid with a 70/10/20 copolymer of diethylaminopropyl acrylamide/ acrylamide/potassium acrylate (MW = 300,000) | 1.0 |
| Others: | |
| Antioxidant (2,4-di-tert-butyl-p-cresol) | 1.0 |
| Anti-rusting/anti-corrosion agent ($C_{18}$-alkenylsuccinic acid) | 1.0 |
| Total | 100.0 |
| Invention product No. 5: | |
| Component (a): | |
| Mineral oil of a paraffin series (30 cSt/40° C.) | 77.0 |
| Component (b): | |
| Oleic acid | 5.0 |
| Butyl stearate | 10.0 |
| Component (c): | |
| Triisooctyl phosphite | 5.0 |
| Component (d): | |
| Polymer dispersant (E): the neutralization product of glycolic acid with a 84/1/15 copolymer of dimethylaminopropyl methacrylamide/acrylamide/sodium acrylate (MW = 50,000) | 1.0 |
| Others: | |
| Antioxidant (2,4-di-tert-butyl-p-cresol) | 1.0 |
| Anti-rusting/anti-corrosion agent ($C_{18}$-alkenylsuccinic acid) | 1.0 |
| Total | 100.0 |
| Comparative product No. 1: | |
| Commercially available hot rolling oil composition for Al (anionic surfactant) | |
| Comparative product No. 2: | |
| Mineral oil (30 cSt/40° C.) | 82.5 |
| Oleic acid | 5.0 |
| Beef tallow | 5.0 |

| | wt. % |
|---|---|
| Tricresyl phosphate | 2.5 |
| Antioxidant (2,4-di-tert-butyl-p-cresol) | 1.0 |
| Anti-rusting agent/Anticorrosion agent ($C_{18}$-alkenylsuccinic acid) | 1.0 |
| Nonionic surfactant (I) | 3.0 |
| Total | 100.0 |
| Comparative product No. 3: | |
| Mineral oil (100 cSt/40° C.) | 51.0 |
| Oleic acid | 10.0 |
| Palm oil | 10.0 |
| Butyl stearate | 20.0 |
| Tricresyl phosphate | 5.0 |
| Antioxidant (2,4-di-tert-butyl-p-cresol) | 1.0 |
| Anti-rusting agent/Anticorrosion agent ($C_{18}$-alkenylsuccinic acid) | 1.0 |
| Polymer dispersant (A) | 2.0 |
| Total | 100.0 |
| Comparative product No. 4: | |
| Mineral oil of a paraffin series (20 cSt/40° C.) | 80.5 |
| Oleic acid | 5.0 |
| Lauryl oleate | 10.0 |
| Monooctyl phosphate | 2.5 |
| Antioxidant (2,4-di-tert-butyl-p-cresol) | 1.0 |
| Polymer dispersant (E): the neutralization product of phosphoric acid with a 6/1/1 copolymer of dimethylaminoethyl methacrylate/dodecyl methacrylate/sodium acrylate (MW = 300,000) | 1.0 |
| Total | 100.0 |
| Comparative product No. 5: | |
| Mineral oil of a paraffin series (20 cSt/40° C.) | 80.5 |
| Lauric acid | 5.0 |
| Palm oil | 5.0 |
| Oleyl oleate | 5.0 |
| Dioleyl phosphate | 2.5 |
| Polymer dispersant (G): the neutralization product of phosphoric acid with a 3/1/1 copolymer of dimethylaminoethylmethyl methacrylamide/sodium acrylate/sodium vinyl sulfonate (MW = 200,000) | 0.5 |
| Antioxidant (2,4-di-tert-butyl-p-cresol) | 0.5 |
| Anti-rusting/anti-corrosion agent ($C_{18}$-alkenylsuccinic acid) | 1.0 |
| Total | 0.5 |
| Comparative product No. 6 | 100.0 |
| Mineral oil (20 cSt/40° C.) | 84.0 |
| Beef tallow | 10.0 |
| Trioctyl phosphite | 5.0 |
| Polymer dispersant (H): the neutralization product of glycolic acid with a 6/1 copolymer of dimethylaminoethyl methacrylate/sodium acrylate (MW = 500,000) | 1.0 |
| Total | 100.0 |

Test Example 1—Rolling Test

Using the oil compositions obtained in Example 1, the rolling lubricity and surface quality of the rolled plate were evaluated according to the method described below. The rolling lubricity is understood from the draft and rolling load. The surface quality is determined by the number of the rolled plates and the roughness of the surface (in the direction of the width).

Test Method

Using a two-high rolling mill (200 mm in diameter×200 mm in width, roll material: ball bearing steel, Hs (shore hardness)=65), the rolling lubricity of each rolling oil composition and the surface quality obtained were investigated.

Rolling Conditions

Rolled material: Pure aluminum material (80 mm in width×700 mm in length×3.5 mm in thickness)

Roughness of the roll: An abrasive paper was used to grind the surface of the rolls in the rolling direction to have an Ra (Average height of roughness profile) of 0.3 to 0.4 μm.

Plate temperature: 480 ° C.

Rolling speed: 50 m/min

Reduction ratio: 40% and 60% (for examining rolling lubricity), 60% (for examining surface quality of rolled plates)

Number of rolled plates: 5 plates (for examining rolling lubricity) and 100 plates (for examining surface quality) for each Reduction ratio.

Conditions of Rolling Oils

Oil concentration in emulsion: 2 vol %

Temperature: 60° C.

Stirring: Homomixer, 12,000 rpm

Amount of spraying: 2 l/min

Test Example 2—Emulsion Stability Test

Test Methods

A rolling oil composition and water were mixed to a predetermined concentration (2 vol %, 5 l, 60° C.), and stirred with a homomixer at 12,000 rpm to prepare an emulsion. 100 ppm of aluminum powder (−325 mesh) was added thereto and the obtained mixture was stirred for 5 hours to prepare a test emulsion. A heated aluminum plate (material: pure aluminum plate, 80 mm in width×150 mm in length×5 mm in thickness, 500° C.) was immersed in this emulsion and taken out after 5 seconds. Immersion was repeated (homomixer: 12000 rpm), during which the particle size of the emulsion was measured with a coulter counter to evaluate the long-term emulsion stability from the variation of the average particle size (volume distribution) against the number of immersed plates.

Results

The results of Test Examples 1 and 2 are shown in Table 1.

TABLE 1

| Rolling oil compositions | Load of rolling (kg/mm) Reduction Ratio 40% | Load of rolling (kg/mm) Reduction Ratio 60% | Roughness (Rz*) of rolled surface (μm) Plate No. 1 | Roughness (Rz*) of rolled surface (μm) Plate No. 100 | Average particle size (μm) Before immersion | Average particle size (μm) After 100 plates have been immersed | Average particle size (μm) After 1000 plates have been immersed |
|---|---|---|---|---|---|---|---|
| Invention product No. 1 | 83 | 146 | 3.0 | 3.9 | 5.0 | 4.9 | 4.8 |
| Invention product No. 2 | 94 | 170 | 3.0 | 3.3 | 11.5 | 11.3 | 12.2 |
| Invention product No. 3 | 91 | 162 | 3.0 | 3.5 | 9.2 | 9.2 | 9.0 |
| Invention product No. 4 | 83 | 172 | 3.0 | 3.2 | 10.2 | 10.3 | 10.5 |
| Invention product No. 5 | 100 | 173 | 3.0 | 3.1 | 7.5 | 7.4 | 7.6 |
| Comparative product No. 1 | 189 | 315 | 3.0 | 5.4 | 1.8 | 2.0 | 3.2 |
| Comparative product No. 2 | 150 | 252 | 3.0 | 7.5 | 5.3 | 8.8 | 20.6 |
| Comparative product No. 3 | 99 | 170 | 3.0 | 9.5 | 5.2 | 5.2 | 5.1 |
| Comparative product No. 4 | 101 | 176 | 3.0 | 3.1 | 5.5 | 5.3 | 2.9 |
| Comparative product No. 5 | 91 | 160 | 3.0 | 3.5 | 8.0 | 7.7 | 3.8 |
| Comparative product No. 6 | 100 | 168 | 3.0 | 3.6 | 6.5 | 6.3 | 3.4 |

*Rz = Ten point height of irregularities of roughness profile.

As shown in Table 1, the present compositions (No. 1~No. 5) exhibited excellent rolling lubricity compared with the comparative products, and the obtained rolled products had a surface of suppressed roughness, exhibiting excellent surface quality.

In addition, the present compositions exhibited excellent emulsion stability over a prolonged period. From the results of the test data in Examples 1 and 2, it was confirmed that the present oil compositions satisfy all the three requirements of rolling lubricity, surface quality of rolled products, and emulsion stability over time.

However, comparative product No. 1 exhibited poor rolling lubricity, No. 2 has poor rolling lubricity and stability, No. 3 has poor surface quality, and No. 4~No. 6 have poor emulsion stability.

The present hot rolling oil compositions have a suitable particle size and exhibit high lubricity. Therefore, the compositions minimize variations of depression amounts, and have excellent lubricity when the compositions are fresh. The latter feature enables rolling of high-strength materials immediately after the fresh oil compositions are supplied to the mill. In addition, the concentration of the rolling oil compositions in oil-in-water emulsions can be reduced. Also, since the compositions have an excellent long-term lubricity and roll coating controlling effects, they are free from deterioration in depression or slip flaws problems after a long-term use which are not avoided by conventional rolling oils. As a result, excellent surface quality of rolled products can be obtained over time in a constant manner.

Furthermore, thanks to the functions of the polymer dispersant, fouling of the housing around tanks and mills can be reduced, leading to an improved waste water treatment property.

What is claimed is:

1. An oil composition which is dispersible in water, comprising the following components (a) to (d);

(a) a mineral oil having a viscosity at 40° C. of not more than 80 cSt, (b) 15 to 30% by weight of a compound selected from the group consisting of $C_{10}$–$C_{22}$ fatty acids, oils and fats, monoesters of a $C_{10}$–$C_{22}$ fatty acid and a $C_1$–$C_{22}$ alcohol, and mixtures thereof, (c) 0.5 to 5% by weight of a $C_4$–$C_{18}$ alkyl or alkenyl phosphoric acid ester or a $C_4$–$C_{18}$ alkyl or alkenyl phosphorous acid ester, (d) 0.1 to 3% by weight of an organic acid salt of a polymer, wherein the polymer has an average molecular weight of 10,000 to 1,000,000 and is a copolymer of one or more monomers represented by the following formula (1):

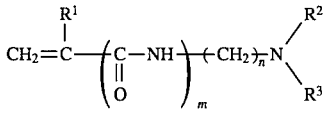

(1)

wherein $R^1$ is hydrogen or methyl, $R^2$ and $R^3$ are independently hydrogen or $C_1$–$C_3$ alkyl, m is an integer of 0 or 1, and n is an integer of 1 to 3, and at least one additional monomer selected from the group consisting of (meth)acrylamide and (meth)acrylic acid salts, and the organic acid is represented by the following formula (2):

$$R^4COOH \quad (2)$$

wherein $R^4$ is $C_1$–$C_5$ alkyl, hydroxy-$C_1$–$C_5$-alkyl, carboxy-$C_1$–$C_5$-alkyl or carboxyl.

2. The composition according to claim 1, wherein $R^4$ is a hydroxy-$C_1$–$C_5$-alkyl group.

3. The composition according to claim 1, wherein component (d) contains from 50 to 90 mol % of the monomer of the formula (1), from 0 to 20 mol % of (meth)acrylamide and from 10 to 50 mol % of the (meth)acrylic acid salt.

4. The composition according to claim 2, wherein component (d) contains from 50 to 90 mol % of the monomer of the formula (1), from 0 to 20 mol % of (meth)acrylamide and from 10 to 50 mol % of the (meth)acrylic acid salt.

5. The composition according to claim 1, wherein m in the formula (1) is 1.

6. The oil composition of claim 1, wherein said oils and fats are selected from the group consisting of animal and vegetable fats and oils.

7. The oil composition of claim 6, wherein said animal and vegetable fats and oils are selected from the group consisting of whale oil, beef tallow, lard, rapeseed oil, castor oil, palm oil and coconut oil.

* * * * *